US007625462B2

(12) United States Patent
Liu

(10) Patent No.: US 7,625,462 B2
(45) Date of Patent: Dec. 1, 2009

(54) TISSUE PRODUCTS CONTAINING TRIGGERABLE POLYMERIC BONDING AGENTS

(75) Inventor: Kou-Chang Liu, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 602 days.

(21) Appl. No.: 11/408,120

(22) Filed: Apr. 20, 2006

(65) Prior Publication Data

US 2007/0246180 A1 Oct. 25, 2007

(51) Int. Cl.
*D21H 17/33* (2006.01)
*D21H 17/37* (2006.01)
*D21H 17/45* (2006.01)
*D21H 21/18* (2006.01)

(52) U.S. Cl. ..... 162/164.3; 162/158; 162/164.4; 162/164.6; 162/168.3; 526/279; 526/303.1; 526/307; 526/319; 526/348

(58) Field of Classification Search ..... 162/158, 162/164.3, 164.4, 164.6, 168.3; 526/279, 526/303.1, 307, 319, 348
See application file for complete search history.

(56) References Cited

U.S. PATENT DOCUMENTS 3,669,829 A 6/1972 Caldo et al.
3,752,733 A * 8/1973 Graham et al ..... 524/13
3,795,575 A 3/1974 Gouw
4,273,892 A 6/1981 Rave
5,200,036 A * 4/1993 Noda ..... 162/164.3
5,916,547 A * 6/1999 Torgerson et al. ..... 424/70.12
6,096,152 A * 8/2000 Anderson et al. ..... 156/183
6,177,063 B1 * 1/2001 Hutchins ..... 424/47
6,224,714 B1 * 5/2001 Schroeder et al. ..... 162/164.4
6,565,707 B2 5/2003 Behnke et al.
6,702,923 B1 * 3/2004 Gorzynski et al. ..... 162/164.6
6,887,961 B2 * 5/2005 Soerens et al. ..... 526/320
2003/0077314 A1 * 4/2003 Shannon et al. ..... 424/443
2003/0119402 A1 * 6/2003 Melius et al. ..... 442/327
2003/0129392 A1 * 7/2003 Abuto et al. ..... 428/373

* cited by examiner

*Primary Examiner*—Eric Hug
*Assistant Examiner*—Dennis Cordray
(74) *Attorney, Agent, or Firm*—Gregory E. Croft

(57) ABSTRACT

Polymeric bonding agents having a "triggerable" bonding functionality and which are in the form of particles or fibers, are blended with papermaking fibers prior to formation of a tissue web. After the web is dewatered, and advantageously during or after drying, the triggerable bonding functionality is activated to strengthen the resulting sheet structure. Tissue sheets prepared in this manner can exhibit an improved combination of softness, bulk and strength.

10 Claims, 2 Drawing Sheets

TISSUE PRODUCTS CONTAINING TRIGGERABLE POLYMERIC BONDING AGENTS

BACKGROUND OF THE INVENTION

It is highly desirable in the paper tissue industry to provide tissue products, such as bath tissues, facial tissues or kitchen towels, having a structure that exhibits the desired value for several properties, such as dry and wet strength, bulk, flexibility and resiliency. Structures having a relatively high bulk generally lead to better absorption and more effective cleaning. Flexible structures offer lower stiffness, a softer hand feel and may also improve cleaning properties. However, due to the formation of hydrogen bonding among fibers during the tissue web dewatering and drying processes, tissue sheets resulting from conventional wet-laid tissue making processes tend to have a sheet structure which exhibits a relatively high density (low bulk), high stiffness (low softness) and low resiliency (poor hand feel and low sheet bulk in wound products).

Therefore there is a need for a simple method of making a tissue sheet having a unique structure which simultaneously exhibits a combination of desirable properties, such as high bulk, flexibility and resiliency with good absorption, soft hand feel and suitable wet and dry strength.

SUMMARY OF THE INVENTION

It has now been discovered that tissue products having increased bulk, lower stiffness and good strength can be produced by incorporating chemical fibers or particles containing triggerable polymeric bonding agents into the fiber furnish prior to forming the tissue web. Initially, the triggerable polymeric bonding agents do not bond to any appreciable extent to the papermaking fibers as the newly-formed web is formed and subsequently dewatered, which creates a more open web structure by inhibiting fiber-to-fiber contact and thereby minimizing the opportunity to form hydrogen bonds between fibers. Thereafter, the bonding capability of the triggerable polymeric bonding agent is activated by the appropriate stimulus, such as heat, causing the triggerable polymeric bonding agent to covalently bond to the nearest fiber(s) and/or other triggerable polymeric bonding agent particles or fibers and generate strength. Since the resulting web contains fewer bonds than a comparable web made without the presence of the triggerable polymeric bonding agent, the final web structure is more flexible, and hence softer, than conventional webs held together solely by more numerous hydrogen bonds.

Hence in one aspect, the invention resides in a tissue sheet comprising papermaking fibers and from about 0.1 to about 50 dry weight percent of a polymeric bonding agent which is covalently bonded to the papermaking fibers within the sheet, said polymeric bonding agent being a random or block copolymer comprising from about 5 to about 10,000 units of monomer "A" and from about 1 to about 1000 units of monomer "B", wherein "A" is a vinyl ester or amide of an alkyl carboxylic acid having from 1 to about 30 carbon atoms and "B" is selected from the group consisting of acrylate, methacrylate, acrylamide and methacrylamide. (As used herein, a covalent bond is a chemical bond between two atoms or radicals formed by sharing one or more pairs of electrons.) Prior to bonding, the polymeric bonding agent molecule carries at least one functionality that can react with hydroxyl groups on wood fibers and/or with a cross-linker and/or can form covalent bonds with another triggerable polymeric bonding agent molecule upon the application of a triggering event. Upon the application of a triggering event, the polymeric bonding agents form a polymer network and simultaneously bond to the cellulosic fibers. Depending upon the amount/degree of crosslinking and/or polymer-fiber bonding, a bulky, flexible and resilient tissue sheet with the desired strength can be prepared.

In another aspect, the invention resides in a method of making a tissue sheet comprising: (a) forming an aqueous suspension of cellulosic papermaking fibers and from about 0.1 to about 50 dry weight percent particles or fibers of a triggerable polymeric bonding agent, said triggerable polymeric bonding agent being a random or block copolymer comprising from about 5 to about 10,000 units of monomer "A" and from about 1 to about 1000 units of monomer "B", wherein "A" is a vinyl ester or amide of an alkyl carboxylic acid having from 1 to about 30 carbon atoms and "B" is selected from the group consisting of acrylate, methacrylate, acrylamide and methacrylamide; (b) depositing the aqueous suspension of papermaking fibers and triggerable polymeric bonding agent onto a forming fabric and forming a tissue web; and (c) dewatering and drying the tissue web to form a tissue sheet, wherein the triggerable polymeric bonding agent is activated to form covalent bonds within the tissue sheet. Since the triggerable polymeric bonding agent particles or fibers do not form hydrogen bonds or form a relatively small number of hydrogen bonds with the cellulosic fibers, the resulting tissue webs exhibit high bulk and flexibility, but poor dry and wet tensile strength, until after a triggering event is applied. The triggering event can be heat, ultra-violet light (UV) or other energy sources. Alternatively, the triggering event can be the removal of a protective layer which covers or coats the polymer.

Any wet-laid papermaking process can be used to produce the tissue sheets of this invention. Wet-laid papermaking processes are conventional and well known in the art. Such process generally include forming an aqueous suspension of papermaking fibers, depositing the aqueous suspension onto a forming wire or between two forming wires to form a tissue web, dewatering the web, and drying the web. Drying can be carried out by conduction, such as by using a Yankee dryer, or by convection, such as using a throughdryer, or combinations of one or more dryers. Creping of the dried web is optional.

Suitable papermaking fibers include any cellulosic fibers known to be useful for making tissue webs, particularly including hardwood and softwood fibers.

The triggerable polymeric bonding agent is a solid at room temperature and can be in the form of particles, such as beads or powders, or fibers. In general, the triggerable polymeric bonding agent should be of a size and shape that does not adversely degrade the formation of the web and blends well with the cellulosic fiber structure. If particles are used, the average equivalent diameter of the particles can be from about 0.001 to about 10 millimeters (mm), more specifically from about 0.01 to about 5 mm, and still more specifically from about 0.05 to about 1 mm. If fibers are used, the average fiber length can be from about 0.05 to about 20 mm, more specifically from about 0.1 to about 5 mm, and still more specifically from about 0.3 to about 3 mm. The average diameter of the fibers can be from about 0.001 to about 5 mm, more specifically from about 0.01 to about 1 mm, and still more specifically from about 0.05 to about 0.5 mm.

The amount of the triggerable polymeric bonding agent in the tissue web or tissue sheet, based on the amount of fiber, can be from about 0.1 to about 50 dry weight percent, more specifically from about 0.5 to about 30 dry weight percent, more specifically from about 1 to about 20 dry weight percent, and still more specifically from about 2 to about 10 dry weight percent. The particular amount used will depend upon the desired properties of the final tissue product.

The triggerable polymeric bonding agent particles or fibers can be coated with a protective film that carries the triggerable polymeric bonding agent through the papermaking process and prevents the covalent bonding from occurring until the web reaches the desired point in the process, such as during or after drying. Particularly suitable protective film materials for this purpose are thermoplastic polymers that readily melt away from the coated fiber or particle during drying of the tissue web, thereby exposing the reactive functionalities on polymeric bonding agent and allowing them to bond to the cellulosic fibers. A suitable protective film has a melting point of from about 30 to about 350° C., more specifically from about 40 to about 250° C., and still more specifically from about 50 to about 150° C. Particularly suitable film materials are polyolefins (such as polyethylene and polypropylene); polyesters (such as poly(ethylene terephthalate) and poly (1,6-hexamethylene adipate)); polyamides (such as polycaprolactam and poly(1,4-butylene succinamide)); polyacrylics; and polyvinyls. Examples of methods for the preparation of a coated chemical fiber can be found in "Microencapsulation and Related Drug Processes" by Patrick B. Deasy, Marcel Dekker, New York, 1984, herein incorporated by reference.

The point at which the bonding capability of the triggerable polymeric bonding agent is activated can be at any point in the process where the consistency of the web is from about 50 to 100 percent, more specifically from about 80 to 100 percent, and still more specifically from about 90 to 100 percent. It is particularly advantageous for the web to be substantially dry prior to activating the bonding capability so that water molecules will not compete effectively with hydroxyl groups on the fibers that are available for reacting with the triggerable polymeric bonding agent.

For triggerable polymeric bonding agents that are triggered by heat, the chemical reactions can be induced by a variety of heating devices, including infra-red radiation. However, to simplify the tissue manufacturing process and lower the production costs, the bonding/curing process is preferably carried out by passing the non-polymer-bonded web over a Yankee dryer or a throughdryer. The temperature required for triggering the covalent bonding reactions can be from about 30 to about 350° C., more specifically from about 50 to about 250° C., and still more specifically from about 70 to about 150° C. Depending upon the temperature and the desired level of bonding, the time duration for completing the bond formation can be from about 0.01 second to about 10 minutes, more specifically from about 0.05 second to about 1 minute, and still more specifically from about 0.1 to about 20 seconds.

As previously mentioned, the triggerable polymeric bonding agent can be a random or block copolymer having units derived from monomers "A" and "B". Optionally, the triggerable polymeric bonding agent can include units derived from one or more of monomer "C", monomer "D" and monomer "E" (all described below).

In one embodiment (as stated above), monomer "A" can be a vinyl ester or amide of an alkyl carboxylic acid having from 1 to about 30 carbon atoms. Specific species of monomer "A" include, without limitation: vinyl acetate; vinyl propionate; vinyl caprolactam; vinyl decanoate; vinyl 2-ethylhexanoate; 1-vinyl-2-pyrrolidinone; and vinyl stearate. The number of "A" units in the polymer can be from about 5 to about 10,000, more specifically from about 10 to about 10,000, and still more specifically from about 20 to about 10,000.

As stated above, monomer "B" is selected from the group consisting of acrylate, methacrylate, acrylamide and methacrylamide. Preferably, monomer "B" includes one or more of an epoxide and/or isocyanate functionality. Specific species of monomer "B" include, without limitation: N-methylol acrylamide; 1,2-epoxy-5-hexene; an acrylate carrying a polysiloxane group; and a methacrylamide having an isocyanate group. The number of "B" units in the polymer can be from 1 to about 1000, more specifically from about 2 to about 1000, and still more specifically from about 2 to about 500.

Monomer "C" can be an olefin. Specific species of monomer "C" include, without limitation: ethylene; propylene; and 1-dodecene. The number of "C" units in the polymer can be from 0 to about 10,000, more specifically from 1 to about 10,000, more specifically from about 5 to about 10,000 and still more specifically from about 5 to about 1000.

Monomer "D" can be an acrylate or acrylamide carrying a cationic charge. Specific species include, without limitation: dimethylaminoethyl methacrylate ethylsulfate; methacrylamidopropyltrimethylammonuium chloride; and a quaternary ammonium cationic monomer, such as diallyldimethylammonium chloride. The number of "D" units in the polymer can be from 0 to about 1,000, more specifically from 1 to about 1,000, still more specifically from about 5 to about 1,000.

Monomer "E" can be a vinyl alcohol, an ether product of a vinyl alcohol and a polysiloxane, or an ester product of a vinyl alcohol and a polysiloxane. The number of "E" units in the polymer can be from 0 to about 500, more specifically from about 1 to about 500 and still more specifically from 1 to about 200.

If used to further enhance the bonding of the resulting polymer network of the tissue sheet, an effective amount of one or more crosslinking agents having a plurality of reactive groups, such as hydroxyl or amine bonding groups, can be used. The amount of the crosslinking agent used will depend on a variety of factors, such as the desired amount of crosslinking, the number of crosslinking bonding groups per molecule, the nature and degree of the triggering event, etc. Suitable crosslinking agents include, without limitation: ethylene glycol; propylene glycol; 1,4-butanediol; 1,6-hexanediol; glycerin; erythritol; sorbitan; ethylene diamine; triethylenetetramine; erythritol; glucose; glycerol monostearate; glyceryl phthalate; sorbitol; polyalcohols; copolymers of 3-aminopropyl and methacrylamide; polyoxylkyleneamines, such as Jeffamine XTJ-506 and Jeffamine XTJ-502 from Huntsman Corporation; and polyethylene glycols, such as Carbowax PEG-75, PEG-90 and PEG 100 from Dow Chemical.

The cellulose fibers are depicted by the white spaces between the relatively thin lines, while the triggerable polymeric bonding agent fibers are depicted by the solid dark areas.

Figure 1:
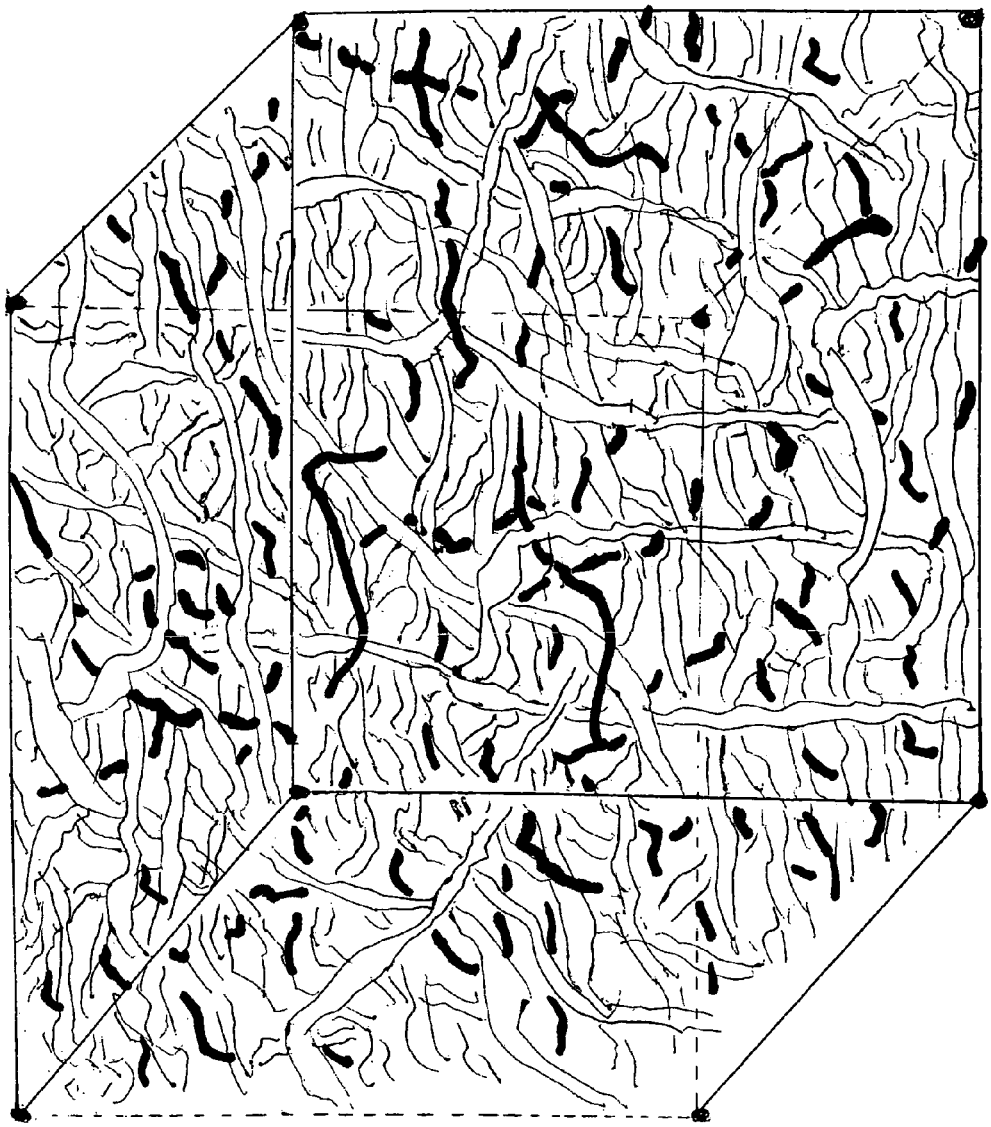
FIG. 1 is a schematic illustration of a section of a tissue sheet structure prepared from a mixture of wood fibers and triggerable polymeric bonding agent fibers in accordance with this invention prior to activation of the triggering event.
Figure 2:
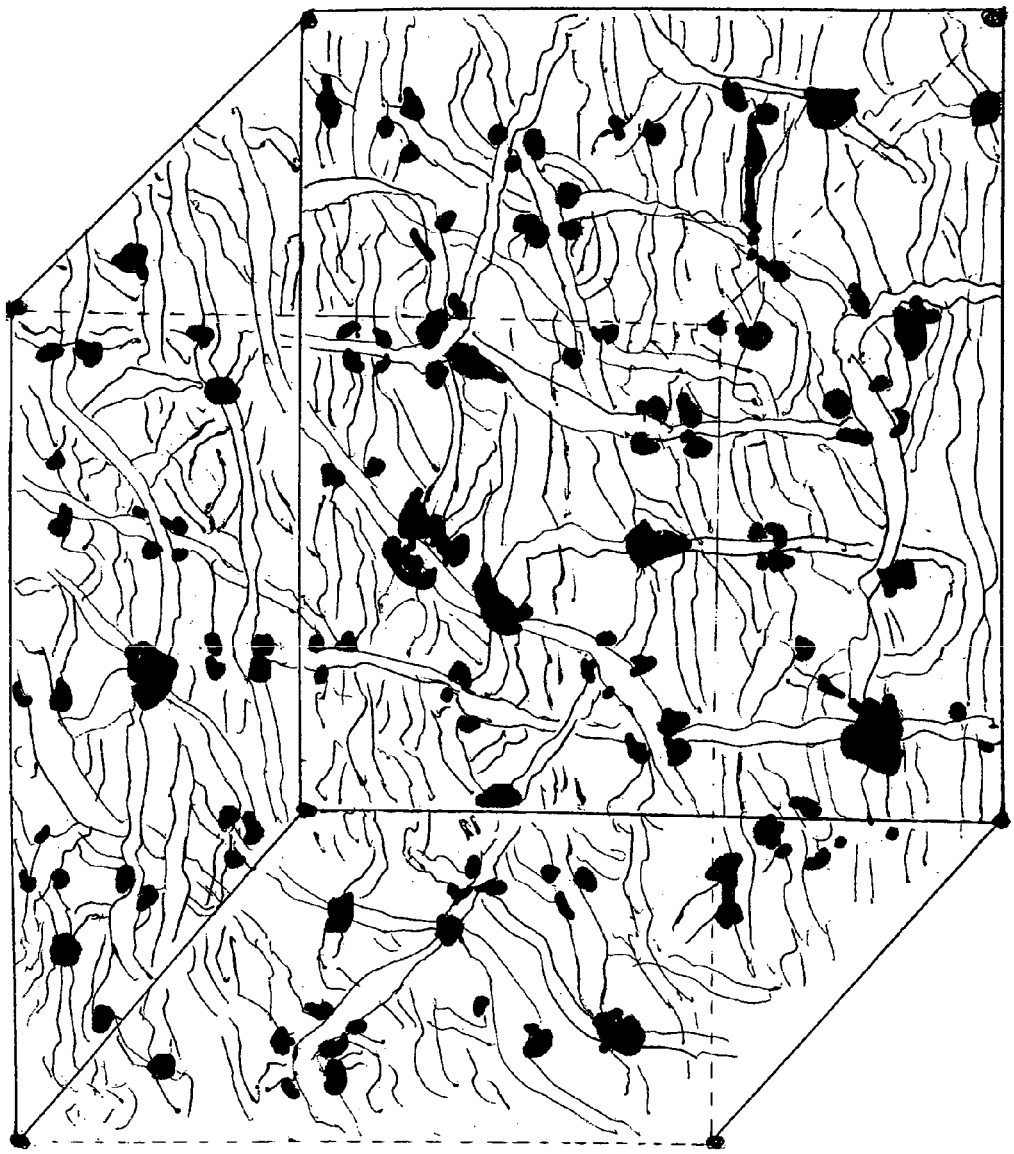

FIG. 2 is a schematic illustration of the tissue sheet of FIG. 1 after the triggering event, illustrating how the triggerable polymeric bonding agent fibers have melted to form globules that can mechanically and/or chemically bond to the fibers within the tissue structure.

EXAMPLES

Example 1

The following polymer structure represents one embodiment of a triggerable polymeric bonding agent (-A-C-B-) useful in accordance with this invention:

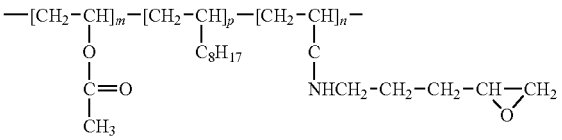

wherein "m"=20 to 10,000;
"n"=2 to 500; and
"p"=5 to 1000.

In order to produce a tissue sheet in accordance with this invention, a tissue making furnish of 97 dry weight percent cellulose papermaking fibers (northern softwood) can be mixed with 3 dry weight percent fibers of the triggerable polymeric bonding agent described above and an effective amount of a crosslinking agent which has an average of 10 amino-functional groups per molecule. A suitable crosslinking agent for use with this example can be a monomeric or polymeric chemical having at least two functional groups, such as hydroxyl or amino groups, in one molecule that can react with the epoxy groups of the triggerable polymeric bonding agent. The triggerable polymeric bonding agent fibers can have an average length of about 1 millimeter and a diameter of about 0.05 millimeter. The fibrous furnish is mixed in an aqueous suspension, fed to a papermaking headbox and deposited onto a forming fabric in a conventional manner. The resulting fibrous web is partially dewatered to about 30 percent consistency with the aid of vacuum dewatering. The web is further dewatered and transferred to a Yankee dryer using a pressure roll which serves to express water from the web and causes the web to adhere to the surface of the Yankee dryer. The Yankee dryer can have a a surface temperature of about 150° C. and a surface speed of about 1500 feet per minute. As the web is dried and the temperature of the web reaches about 140° C., the fibers of the triggerable polymeric bonding agent will begin to melt. A portion of the epoxyl groups on the triggerable polymeric bonding agent will react with the amino groups of the crosslinking agent to form a polymer network, while other epoxyl groups react with the hydoxyl groups of the cellulose fibers. The resulting dried tissue sheet is then wound into a roll for subsequent conversion into the final tissue product in a conventional manner.

Example 2

The following structure represents another embodiment of a triggerable polymeric bonding agent (-A-C-B-) for use in accordance with this invention:

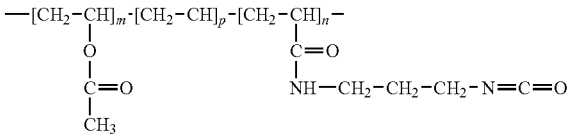

wherein "m"=20 to 10,000;
"n"=2 to 500; and
"p"=20 to 10,000.

In order to produce a tissue sheet in accordance with this invention, a tissue making furnish can be produced which contains about 95 dry weight percent cellulose papermaking fibers (a mixture of about 50 dry weight percent northern softwood fibers and about 50 dry weight percent eucalyptus fibers), about 5 dry weight percent fibers of the triggerable polymeric bonding agent described above coated with a polyethylene protective film, and a crosslinking agent which has an average of 25 hydoxyl-functional groups per molecule. A suitable crosslinking agent for this embodiment is a momeric or polymeric chemical having at least two isocyanate-reactive groups, such as hydroxyl or amino groups, in one molecule. The polyethylene-coated triggerable polymeric bonding agent fibers can have an average length of about 0.5 millimeter and a diameter of about 0.05 millimeter. The furnish is mixed in an aqueous suspension, fed to a papermaking headbox and deposited onto a forming fabric in a conventional manner. The resulting web is partially dewatered to about 30 percent consistency with the aid of vacuum dewatering. The web is further dewatered and transferred to a Yankee dryer using a pressure roll which serves to express water from the web and causes the web to adhere to the surface of the Yankee dyer. The Yankee dryer can have a surface temperature of about 120° C. and surface speed of about 4000 feet per minute. As the web is dried and the temperature of the web reaches about 110° C., the protective polyethylene coating on the triggerable polymeric bonding agent fibers begins to melt. In addition, the triggerable polymeric bonding agent fibers also begin to melt and a portion of the isocyanate groups on the triggerable polymeric bonding agent fibers reacts with the hydroxyl groups of the crosslinking agent to form a polymer network while other isocyanate groups react with hydoxyl groups on the cellulose papermaking fibers. The dried web is creped from the Yankee dryer and the resulting tissue sheet is wound into a roll and thereafter converted in a tissue product in a conventional manner.

Example 3

The following structure represents another embodiment of a triggerable polymeric bonding agent (-A-E-B-A-) useful in accordance with invention:

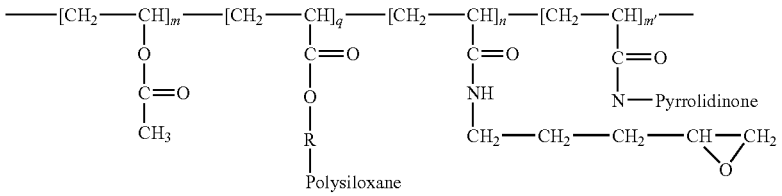

wherein "m"=20 to 1,000;

"m'"=5 to 1000;

"n"=2 to 500; and

"q"=1 to 200.

In order to produce a tissue sheet in accordance with this invention, a tissue making furnish of about 92 dry weight percent northern softwood can be mixed with about 8 dry weight percent triggerable polymeric bonding agent fibers and a crosslinking agent having an average of 30 hydroxyl functional groups per molecule. The fibers can have an average length of about 2 millimeters and a diameter of about 0.1 millimeter. The furnish is mixed in an aqueous suspension, fed to a papermaking headbox and deposited onto a forming fabric in a conventional manner. The resulting web is partially dewatered to about 30 percent consistency with the aid of vacuum dewatering. The web is thereafter throughdried in a conventional manner. The throughdryer can have a surface temperature of about 105° C. and a surface speed of about 500 feet per minute. A portion of the epoxy groups on the triggerable polymeric bonding agent fibers will react with the hydroxyl groups of the crosslinking agent to form a polymer network while other epoxy groups will react with hydoxyl groups of the cellulose papermaking fibers. The resulting web is wound into a roll and thereafter converted to a final tissue product in a conventional manner.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following sub-ranges: 1-4; 1-3; 1-2; 2-5; 2-4; 2-3; 3-5; 3-4; and 4-5.

It will be appreciated that the foregoing examples, given for purposes of illustration, are not to be construed as limiting the scope of this invention, which is defined by the following claims and all equivalents thereto.

I claim:

1. A tissue sheet comprising papermaking fibers and from about 0.1 to about 50 dry weight percent of a polymeric bonding agent which contains an isocyanate functionality and is covalently bonded to the papermaking fibers within the sheet, said polymeric bonding agent being a random or block copolymer comprising from about 5 to about 10,000 units of monomer "A"and from about 1 to about 1000 units of monomer "B", wherein "A" is a vinyl ester or amide of an alkyl carboxylic acid having from 1 to about 30 carbon atoms and "B" is selected from the group consisting of acrylate, methacrylate, acrylamide and methacrylamide.

2. The tissue sheet of claim 1 wherein the polymeric bonding agent contains an epoxy functionality.

3. The tissue sheet of claim 1 wherein the polymeric bonding agent further comprises from about ito about 10,000 units of monomer "C", wherein "C" is an olefin.

4. The tissue of claim 3 wherein "C" is selected from the group consisting of ethylene, propylene and 1 -dodecene.

5. The tissue sheet of claim 1 wherein the polymeric bonding agent further comprises from about 1 to about 1000 units of monomer "D", wherein "D" is an acrylate or acrylamide carrying a cationic charge.

6. The tissue sheet of claim 5 wherein "D" is selected from the group consisting of dimethylaminoethyl methacrylate ethylsulfate, diallyldimethylammonium chloride and methacrylamidopropyltrimethylammonuium chloride.

7. The tissue sheet of claim 1 wherein the polymeric bonding agent further comprises from about 1 to about 500 units of monomer "E", wherein monomer "E" is selected from the group consisting of vinyl alcohol, an ether of vinyl alcohol and polysiloxane, and an ester of vinyl alcohol and polysiloxane.

8. The tissue sheet of claim 1 wherein the polymeric bonding agent contains a polysiloxane moiety and an epoxy functionality.

9. The tissue sheet of claim 1 wherein the polymeric bonding agent has the following structure:

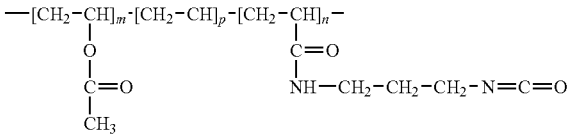

wherein "m"=20 to 10,000;

"n"=2 to 500; and

"p"=20 to 10,000.

10. A tissue sheet comprising papermaking fibers and from about 0.1 to about 50 dry weight percent of a polymeric bonding agent which is covalently bonded to the papermaking fibers within the sheet, wherein the polymeric bonding agent has the following structure:

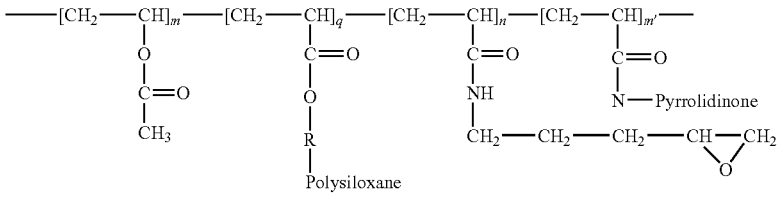
wherein "m"=20 to 1,000;
"m"=5 to 1000;
"n"=2 to 500; and
"q"=1 to 200.
* * * * *

UNITED STATES PATENT AND TRADEMARK OFFICE

CERTIFICATE OF CORRECTION

PATENT NO. : 7,625,462 B2
APPLICATION NO. : 11/408120
DATED : December 1, 2009
INVENTOR(S) : Kou-Chang Liu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 827 days.

Signed and Sealed this

Second Day of November, 2010

David J. Kappos

David J. Kappos
*Director of the United States Patent and Trademark Office*